United States Patent [19]

Covington et al.

[11] 4,229,422

[45] Oct. 21, 1980

[54] METAL EXTRACTION

[75] Inventors: James W. Covington, Stevenage; Robert G. Whittemore, Shefford, both of England

[73] Assignee: Interox Chemicals Limited, London, England

[21] Appl. No.: 897,128

[22] Filed: Apr. 17, 1978

[30] Foreign Application Priority Data

May 3, 1977 [GB] United Kingdom ..... 18510/77

[51] Int. Cl.[2] ..... B01D 12/00

[52] U.S. Cl. ..... 423/20; 423/18; 423/513; 423/521

[58] Field of Search ..... 423/18, 20, 513, 521

[56] References Cited

U.S. PATENT DOCUMENTS

| | | | |
|---|---|---|---|
| 2,789,954 | 4/1957 | Fell | 423/513 X |
| 2,843,451 | 7/1958 | Baird et al. | 423/18 X |
| 2,890,933 | 6/1959 | Michal et al. | 423/18 |
| 2,919,175 | 12/1959 | Kilner et al. | 423/18 |
| 2,926,998 | 3/1960 | D'Addicio et al. | 423/521 |
| 3,183,058 | 5/1965 | Peter | 423/20 |
| 3,790,658 | 2/1974 | Fox et al. | 423/20 |
| 3,801,694 | 4/1974 | Pace et al. | 423/20 |
| 4,049,786 | 9/1977 | Chiang et al. | 423/513 |

FOREIGN PATENT DOCUMENTS

| | | | |
|---|---|---|---|
| 555622 | 4/1958 | Canada | 423/18 |
| 738407 | 10/1955 | United Kingdom . | |
| 844096 | 8/1960 | United Kingdom . | |

OTHER PUBLICATIONS

Clegg et al., *Uranium Ore Processing*, Addison-Wesley, 1958, pp. 115-152 (Chapter 6).

Schmidt, M. et al., "Sulphur," Chapter 23 of *Comprehensive Inorganic Chemistry*, Pergamon Press, Oxford, 1973, pp. 882-883.

*Primary Examiner*—Richard E. Schafer

*Attorney, Agent, or Firm*—Larson, Taylor and Hinds

[57] ABSTRACT

In a process according to the present invention uranium is extracted into solution from its ore by leaching with an aqueous solution containing peroxomonosulphuric acid, the peroxoacid oxidizing the uranium through to its hexavalent state. Preferably the leaching is carried out at a temperature in the range of 50° to 100° C. The leach liquor can initially contain additional amounts of sulphuric acid or merely that present by virtue of the method of making the peroxomonosulphuric acid. In a preferred method of operation, the peroxoacid is introduced progressively into the leach liquor during the course of the leaching so as to maintain an electrochemical potential in the range of 450 to 650 mV.

By use of the process, uranium is cleanly extracted into solution.

8 Claims, No Drawings

METAL EXTRACTION

The present invention relates to the extraction of metals from their ores, and more particularly to the extraction of uranium under oxidative acidic conditions.

Uranium is a highly valuable material which is currently extracted from ores containing it under acidic conditions, or where excessive amounts of acid would be consumed in undesired side reactions, using an alkali metal carbonate solution. Commonly, in acidic leaching of uranium ores, sulphuric acid is used. When appropriate leaching conditions are employed, aqueous sulphuric acid is able to extract into solution a substantial proportion of hexavalent uranium, but in general is not capable of extracting uranium in a lower oxidation state, such as trivalent or tetravalent uranium. Accordingly, in view of the desirability of extracting as great a proportion of the uranium as is practicable, methods have been proposed to oxidise the uranium to the hexavalent state prior to dissolution. Air oxidation is feasible but at atmospheric pressure is relatively slow on account of the low solubility of oxygen in aqueous sulphuric acid. Manganese dioxide can be employed in the presence of iron, but it is a further metal compound that must be separated out at a later stage. Sodium chlorate, again in the presence of iron, can be used, but can result in the build-up of chloride in solution.

According to the present invention there is provided a process for the extraction of uranium from its ore comprising the step of leaching the ground ore with an aqueous acidic solution containing peroxomonosulphuric acid. Herein, peroxomonosulphuric acid will also be referred to briefly as PMS.

By the use of a process according to the present invention oxidative extraction of uranium from its ores can occur cleanly, that is to say without the introduction of other materials which at best would complicate the extraction process and which under less favourable circumstances would disrupt mass balances or require additional purification stages.

Although not restricted to treatment of such ores, the process of the present invention is well suited to treatment of ores which formerly would be considered suitable for treatment using a sulphuric acid solution containing manganese dioxide or its mineral equivalent pyrolusite or under pressure employing air or oxygen as oxidant. In terms of ore composition, the process is well suited to treatment of sulphide-containing ores, the sulphide generally being present in combination with some metal other than uranium, for example, iron, copper, nickel, zinc or two or more of such metals. By the use of PMS evolution of poisonous hydrogen sulphide gas can be substantially suppressed, the sulphide being oxidised either through to oxysulphur anions or to elemental insoluble sulphur. It will therefore be recognised from the above that the process according to the present invention is desirable for treating a wide range of uranium ores, ranging from those in which the uranium is present in very minor amounts, e.g. less than 0.5% as in gold containing ores or spent gold ores in which as little as 100 ppm uranium (measured as $U_3O_8$) can be present up to rich vein ores containing over 20%. The ore is normally ground before being contacted with leach liquor, usually to −25 mesh, and often to −60 mesh with a high proportion below 200 mesh.

Generally, the process empoying PMS is operated at atmospheric pressure, since PMS provides a means for introducing a relatively high concentration of available oxygen into solution without the need for high pressures to overcome the poor solubility of oxygen. However, elevated pressure can be employed, if desired. Optionally PMS can be employed in conjunction with air or oxygen, as for example in apparatus which uses gas to agitate the ore. In such apparatus, relatively low excess pressures of the order of up to 5 atmospheres can be generated.

Leaching with a solution of PMS can be effected at any temperature from ambient up to the boiling point of the solution at the prevailing pressure. Generally speaking, the temperature will be selected in practice in combination with the period of extraction and other variables so as to obtain the desired metal most efficiently. Normally as the temperature is raised, then the period of extraction required to reach peak extraction falls. The temperature selected can vary from ore to ore, or even, as a consequence of local variations, in ore from the same mine. The temperature will frequently be in the range of 50° to 100° C.

Leaching is normally continued until the added value of extra metal extracted, taking into account any additional costs of purification, ceases to exceed the cost of extracting that extra metal. In consequence, the leaching period varies according to the temperature of extraction and according to the particular ore. Thus the leaching period can vary from several days, at ambient temperature (i.e. about 20°–25° C.) down to only a few hours at elevated temperatures in the range of 50°–100° C.

An important aspect of a process according to the present invention is the acidity of the leaching solution. Preferably sufficient acid is present to obtain a final pH below 2 and advantageously below 1. The acidity can be obtained by use of the appropriate concentrations of sulphuric acid and PMS, taking into account the amount of sulphuric acid that will be generated when PMS decomposes.

It will be recognised that PMS solutions contain, in addition to PMS, sulphuric acid, and we have found that PMS is capable of oxidising sulphur under the reaction conditions through to sulphate, thus generating in situ sulphuric acid. Consequently, if desired, the process can be carried out using solely acid in and produced by the PMS solution or only a small amount of added sulphuric acid.

There are various methods of adding the PMS. In one method substantially the entire amount can be mixed with the ore together with or after addition of any further amount of sulphuric acid. In a second method the PMS can be added at prearranged intervals or at a prearranged rate throughout the leaching period. In each of these methods the total amount of PMS is predetermined by, for example, carrying out a preliminary test on a sample of the ore. In a third method, sufficient PMS is introduced initially to obtain a leaching solution/ore mixture having a predetermined electrochemical potential (emf), preferably in the range of +450 to +800 mV with respect to a standard calomel electrode, and PMS is added thereafter either continuously or incrementally, preferably to maintain the emf approximately constant, but some variation in emf is acceptable. Although manual control is possible, it is desirable to employ the output from a standard electrode pair, such as platinium silver/silver chloride, to regulate the introduction of PMS, suitably by establishing two limits about the desired emf, and arranging that when the lower limit is reached, introduction of PMS is triggered, introduction continuing until the upper limit is reached. The cut-in and cut-off of the flow of PMS at the limits can be sharp or if desired, by using a proportioning pump which pumps PMS solution at a rate in inverse relationship with the emf, a smoother control can be achieved. In an alternative method the PMS is added during only the later part of the leaching period, a standard non-oxidising sulphuric acid leach being employed in the earlier part.

In general the amount of PMS to be added depends not only on the amount of oxidisable uranium compounds in the ore, but also upon the amount of other oxidisable materials present. After allowance has been made for such other oxidisable materials, the amount of PMS is preferably at least one mole per mole of oxidisable uranium compound. Less PMS can be used, but could result in poorer extraction of uranium into solution. The principle disadvantage of using excessive amounts of PMS is the additional cost. In consequence, in view of the stability of the PMS under aqueous acidic conditions, even in the presence of high concentrations of transition metals, the amount of PMS used is often not more than twice the amount required theoretically to oxidise all the oxidisable materials. However, higher amounts of PMS can be used without impairing the extent of, and rate of, solution of the uranium.

PMS is normally produced as an aqueous solution additionally containing sulphuric acid. Although in theory any concentration of PMS has some effect, in practice the concentration of PMS is selected in conjunction with any other amount of sulphuric acid used, to produce and maintain the solution at an appropriate pH, as described herein before. A final pH in the range of 0 to 0.5 is especially suitable. Obviously, where the proportion of uranium and the oxidisable impurities in the ore are very low, the total amount of PMS introduced is relatively low so that the concentration prior to introduction into the leaching solution is relatively unimportant. However, where relatively large amounts of PMS are required, the pH of the PMS solution should preferably be matched with that of the leaching solution, so as to avoid dilution of the leaching solution, which could result in reprecipitation of the uranium values. Desirably, the PMS solution contains at least 5% by weight and particularly from 5 to 75% by weight PMS.

PMS solution for use in the present invention can be made suitably by reaction between hydrogen peroxide and sulphuric acid. Suitable conditions are described in British Patent Specifications Nos. 738407 and 844096. Broadly speaking, it is particularly desirable to employ concentrated hydrogen peroxide solution, e.g. in the range of 60 to 85% w/w hydrogen peroxide together with oleum since such a combination enables conversion of the sulphate species to peroxymonosulphuric acid to occur to a greater extent than when more dilute solutions are employed. Provided that precautions normal in respect of exothermic reactions, such as cooling, are carried out, PMS can be generated safely and efficiently by the method outlined above. Alternatively, if desired, PMS can be obtained by hydrolysis of a peroxydisulphate, especially peroxydisulphuric acid produced, e.g. by electrolysis, or the sodium potassium or ammonium salts thereof, hydrolysis to PMS rather than continuing to hydrogen peroxide, occurring most rapidly at temperatures in the range of 50° to 70° C. Because PMS solutions tend to lose their available oxygen content upon storage, even at ambient temperatures, it is preferably to use freshly prepared PMS, for example made and used on the same day. It is convenient to control the generation of PMS by the rate at which it is consumed, such as by employing the output from the emf detector to control the rate at which hydrogen peroxide and sulphuric acid are fed into the reaction chamber as well as or instead of controlling the rate at which PMS is introduced into the leaching liquor.

Uranium containing solutions produced by leaching with PMS solutions can thereafter be treated in standard manner to separate the uranium from any other component of the solutions.

After removal of desired metals from solution, at least a part of the sulphuric acid solution, after further purification if desired, can be recycled as leaching liquor for fresh ore. Also, preferably after concentration where necessary to at least 200 gpl sulphuric acid, at least a part of the solution can be reacted with hydrogen peroxide to form fresh PMS.

Extraction can be carried out using heap or preferably agitation leaching. Batch processes can be employed, but continuous processes for agitation leaching are preferred.

Having described the invention in general terms, two embodiments will now be disclosed more fully by way of example.

In Example 1, the ore leached was a pyritic uraniferous gold ore ground to −200 mesh containing 270 ppm uranium (calc as $U_3O_8$), 1.89% sulphide (calc as S) and 1.8% iron (calc as Fe), %'s being w/w, which was suitable for treatment in a reverse acid leach process using manganese dioxide as oxidant. The uranium was present principally as uranium dioxide, i.e. tetravalent uranium. The PMS was obtained by reacting 70% w/v aqueous hydrogen peroxide and 98% w/v sulphuric acid with continuous stirring and cooling behind a safety screen, and thereafter diluted to a concentration of 10% w/v PMS by addition of distilled water. The apparatus used in the example comprised a 250 ml reaction vessel fitted with a five necked lid, a heating element, a thermostat accurate to ±2° C., a thermometer, a propellor stirrer, operating at 450±100 rpm, and a water cooled condensor. In addition, the apparatus included a fine bore glass tube shaped and positioned so as to introduce the PMS solution immediately underneath the stirrer, a peristaltic pump for pumping the solution, and a standard platinum/calomel electrode to measure the potential.

A 10% w/v slurry (15g/150 ml) of ore in a sulphuric acid solution (100 gpl) was introduced into the reaction vessel, stirred continuously and heated to 90° C. PMS solution was introduced into the slurry during the reaction period of six hours so as to maintain a potential of about +250 mV with respect to the calomel electrode. By the end of the leach period, 122% of the theoretical amount to oxidise all the uranium to the hexavalent state and all the pyrite to ferric sulphate and sulphuric acid had been introduced. The slurry was allowed to cool, the pH of the leach liquor was found to be 0.1, and the iron content 0.9 gpl. 97% of the uranium had been extracted into solution.

In Example 2, the process of Example 1 was repeated at 50° C., but replacing the sulphuric acid solution with the same amount of water, 142% of the theoretical amount of PMS was added during the course of the six hour period, 90% of the uranium was extracted into solution.

We claim:

1. A process for the extraction of uranium from its ore comprising the step of leaching the ground ore with an aqueous acidic solution containing peroxomonosulphuric acid.

2. A process as claimed in claim 1 carried out at a temperature in the range of 50°to 100° C.

3. A process as claimed in claim 1 wherein the leaching solution has a final pH of below 2.

4. A process as claimed in claim 3 wherein the final pH of the leaching solution is in the range of 0 to 0.5.

5. A process as claimed in claim 1 where the acidity of the leaching solution is produced solely by addition of the solution of peroxomonosulphuric acid.

6. A process as claimed in claim 1 wherein the peroxomonosulphuric acid solution is added continuously or incrementally throughout the leaching period.

7. A process as claimed in claim 6 wherein the peroxomonosulphuric acid solution is introduced in such a way as to maintain the electrochemical potential in the range of +450 to +800 mV with respect to a standard calomel electrode.

8. A process as claimed in any preceding claim wherein the total amount of peroxomonosulphuric acid added is not more than twice the theoretical amount required to oxidise all oxidisable materials in the ore.

* * * * *